US010561226B1

(12) United States Patent
Swaggart

(10) Patent No.: US 10,561,226 B1
(45) Date of Patent: Feb. 18, 2020

(54) SHOULDER SLING WITH MEANS FOR ANCHORING EQUIPMENT

(71) Applicant: Matthew Swaggart, Tulsa, OK (US)

(72) Inventor: Matthew Swaggart, Tulsa, OK (US)

( * ) Notice: Subject to any disclaimer, the term of this patent is extended or adjusted under 35 U.S.C. 154(b) by 0 days.

(21) Appl. No.: 16/056,697

(22) Filed: Aug. 7, 2018

(51) Int. Cl.
*A45F 3/14* (2006.01)
*A45F 5/02* (2006.01)
*A45F 3/12* (2006.01)

(52) U.S. Cl.
CPC ..... *A45F 3/14* (2013.01); *A45F 3/12* (2013.01); *A45F 5/021* (2013.01); *A45F 2003/142* (2013.01); *A45F 2200/0533* (2013.01)

(58) Field of Classification Search
CPC .. A45F 3/14; A45F 2003/045; Y10S 224/908; A44B 11/18
See application file for complete search history.

(56) References Cited

U.S. PATENT DOCUMENTS 3,919,615 A * 11/1975 Niecke ..... H01M 10/46 320/112
3,938,166 A * 2/1976 Sloop ..... A45C 11/38 396/423
4,033,488 A * 7/1977 Brewer ..... A45F 3/14 224/259
4,091,974 A * 5/1978 McClintock ..... A45F 5/00 224/257
4,320,863 A * 3/1982 Lyer ..... A45F 3/14 224/259
4,328,917 A * 5/1982 Reeberg ..... A45C 13/20 224/254
4,386,724 A 6/1983 Kotler
4,751,923 A * 6/1988 Marino ..... A61F 5/3738 128/878
4,863,083 A * 9/1989 Chen ..... A63C 11/025 224/663
D309,359 S * 7/1990 Joachim ..... D29/101.1
D342,348 S * 12/1993 Panarelli ..... D29/101.1
D342,563 S * 12/1993 Tukiendorf ..... D3/259
5,477,998 A * 12/1995 Reckler ..... A41D 13/01 224/586
5,802,756 A * 9/1998 Hightower ..... F41C 33/002 42/85
6,311,884 B1 * 11/2001 Johnson ..... A45F 3/04 224/153
6,371,346 B1 * 4/2002 Sharma ..... A45F 3/14 224/195
D683,384 S * 5/2013 Swaggart ..... D16/243
D739,085 S * 9/2015 Tadeo ..... D29/101.1
D757,844 S * 5/2016 Swaggart ..... D16/237
D794,110 S * 8/2017 Swaggart ..... D16/237
D816,759 S * 5/2018 Swaggart ..... D16/243
(Continued)

FOREIGN PATENT DOCUMENTS

DE 202010016350 U1 12/2010

*Primary Examiner* — Brian D Nash
(74) *Attorney, Agent, or Firm* — Cherskov Flaynik & Gurda, LLC

(57) ABSTRACT

Briefly the invention provides a shoulder sling supporting equipment from a slider that is in slidable communication with the length of the shoulder sling, the sling also having a reversibly engagable anchoring mechanism to limit the movement of the equipment during periods of active movement by a user. Also provided is a method for using the invented equipment sling.

14 Claims, 6 Drawing Sheets

(56) References Cited

U.S. PATENT DOCUMENTS

| | | | | |
|---|---|---|---|---|
| 10,216,069 | B2 * | 2/2019 | Nguyen | G03B 17/561 |
| 2007/0257072 | A1 * | 11/2007 | Pena | F41C 23/02<br>224/150 |
| 2008/0203127 | A1 * | 8/2008 | Castillo-Garrison | A45C 13/30<br>224/607 |
| 2008/0217371 | A1 * | 9/2008 | Wemmer | F41C 23/02<br>224/579 |
| 2011/0042430 | A1 * | 2/2011 | Scicluna | A45F 3/02<br>224/264 |
| 2012/0061439 | A1 * | 3/2012 | Wallis | A45F 5/00<br>224/600 |
| 2013/0233902 | A1 * | 9/2013 | Henry | A45F 3/12<br>224/600 |
| 2014/0050468 | A1 * | 2/2014 | Henry | G03B 17/561<br>396/423 |
| 2014/0103084 | A1 * | 4/2014 | Hale | A45F 3/12<br>224/264 |
| 2014/0346199 | A1 * | 11/2014 | Golob | F41C 33/002<br>224/150 |
| 2015/0016813 | A1 * | 1/2015 | Swaggart | G03B 17/566<br>396/423 |
| 2016/0363838 | A1 | 12/2016 | Nguyen | |
| 2017/0360009 | A1 * | 12/2017 | Anderson | A01K 27/008 |
| 2018/0259294 | A1 * | 9/2018 | Smith | F41C 33/002 |

* cited by examiner

SHOULDER SLING WITH MEANS FOR ANCHORING EQUIPMENT

BACKGROUND OF THE INVENTION

1. Field of the Invention

This invention relates to a shoulder sling for carrying equipment, and more specifically, this invention relates to a camera sling with means to reduce the swinging of a camera during periods of activity.

2. Background of the Invention

Many devices exist for attaching a camera to a user, with slings and harnesses being the most popular currently at the time of this application. State of the art camera slings and harnesses feature camera sliders. These sliders attach slidably to the harness or sling at one end and to a camera at the other. This configuration allows the camera to hang securely and hands-free from a harness or sling while not in use and enables a user to grab the hanging camera and slide it up to a shooting position with no lag time.

The invention of these camera harnesses and slings with camera sliders improved on the convenience of previous carrying devices by providing hands-free carrying of cameras without requiring a user to detach a camera from the carrying device before shooting. With the freedom of movement of the camera sliders offered by these state of the art slings and harnesses also came a disadvantage. As the camera sliders allow easy movement along the length of a camera sling and harness, the cameras tend to swing and bounce during periods of high activity of a user, representing danger to the attached cameras and accessories. This is especially true for photographers who are walking or hiking uneven terrain in pursuit of a subject or otherwise following the movements of an active subject.

Thus, a need exists in the art for a system for reversibly anchoring cameras attached to a camera sling or harness to reduce camera movement while not in use. Ideally, the apparatus would reduce the movement of a hanging camera while not in use but allow for quick release to a shooting position.

SUMMARY OF INVENTION

An object of the invention is to provide an apparatus for reversibly limiting the movement of a camera hanging from a camera sling to overcome the disadvantages of the prior art.

Another object of the present invention is to provide an apparatus for quickly and reversibly limiting the movement of a camera hanging from a camera sling on camera sliders. A feature of the invention is an anchoring means featured on or near the waste of a user. An advantage of the apparatus is that its proximity to an inactive camera hanging from a camera sling allows for rapid attachment and detachment of the anchoring means to the camera.

Another object of the present invention is to provide a means for limiting the movement of a camera hanging on a camera slider from a camera harness without need for complicated or awkward camera positioning. A feature of the invention is that the anchoring means can quickly and easily be attached to a hanging camera with minimal movement of the camera. An advantage of the invention is that this rapid attachment allows a user to begin active movements following a subject without wasting time awkwardly positioning a camera into a stable position. Similarly, an advantage of the invention is rapid detachment of the anchoring means from a hanging camera. A feature of the invention is that one hand movement can release the anchoring means and release the camera to a free-shooting configuration.

Yet another object of the present invention is to provide a robust and durable anchoring means for a camera suspended on a camera slider. A feature of the invention is the use of durable and tough materials in the construction of the anchoring means. An advantage of the invention is that the anchoring means strongly resists movement by an anchored camera.

Still yet another object of the present invention is to provide multiple anchoring means to a camera suspended on a camera slider. A feature of the invention is a strap that can be used either as a stabilizing strap for a camera sling by encircling the arm of a user and attaching to the sling or an anchoring means by attaching to a hanging camera. An advantage of the invention is that the user can configure the invented camera sling to be in a stable, photo-shooting configuration or quickly convert to an active movement, camera anchoring configuration.

A further advantage of the invention is that the camera does not have to be manipulated into a specific or complicated position to utilize the anchoring means. Yet another advantage of the invention is that the anchoring means can be integrally integrated into the belt of a user or in an alternative embodiment can be reversibly detachable to the belt or belt loop of a user.

Briefly, the invention provides An equipment sling with anchor point comprising: a first strap configured to overlay a shoulder of a user and extend downwardly across a front and back of said user toward a hip of the user opposite the overlaid shoulder; a secondary strap having a first end and a second end, wherein the first end is in slidable communication with the first strap along a first length of the first strap, and wherein the second end comprises means for reversibly fixing the secondary strap to said equipment; and an anchoring mechanism reversibly attached to the second end of the secondary strap such that the first end of the secondary strap is in slidable communication along a second length of the first strap, wherein the second length is shorter than the first length.

Also provided is a method for limiting movement of equipment suspended from a sling comprising: providing a shoulder sling having a primary strap configured to overlay a shoulder of a user and extend downwardly across a front and back of said user toward a hip of the user opposite the overlaid shoulder and equipment suspended from said primary strap by a secondary strap, wherein the secondary strap is in slidable communication with the primary strap; providing an anchoring mechanism that reversibly limits a range of movement of the secondary strap along the primary strap when the anchoring mechanism is reversibly attached to the secondary strap; and reversibly attaching said anchoring mechanism to said secondary strap.

BRIEF DESCRIPTION OF THE DRAWINGS

The invention together with the above and other objects and advantages will be best understood from the following detailed description of the preferred embodiment of the invention shown in the accompanying drawings, wherein.

DETAILED DESCRIPTION OF THE INVENTION

The foregoing summary, as well as the following detailed description of certain embodiments of the present invention, will be better understood when read in conjunction with the appended drawings.

As used herein, an element or step recited in the singular and preceded with the word "a" or "an" should be understood as not excluding plural said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property. As stated herein, "slidable communication" between two components means that one component may slide along the longitudinal axis of the other.

The present invention is a novel apparatus for temporarily limiting the movement of a camera suspended from a harness or sling from camera sliders. The device may feature one or both of two different anchoring means at the same time. When in use, the anchoring means can be quickly deployed to limit the movement of a hanging camera while a user is active and can be quickly released to allow the camera to move freely.

While useful for attachment to a camera as shown and described herein, this use is exemplary and not meant to be limiting. The invented apparatus can be used to support any equipment or device that can be hung from a shoulder sling. Such equipment or devices include: binoculars, handbags, grocery bags, guns, water bottles, pet leashes, and tote bags. This list is exemplary and not meant to be limiting.

Device Detail

Figure 1A:
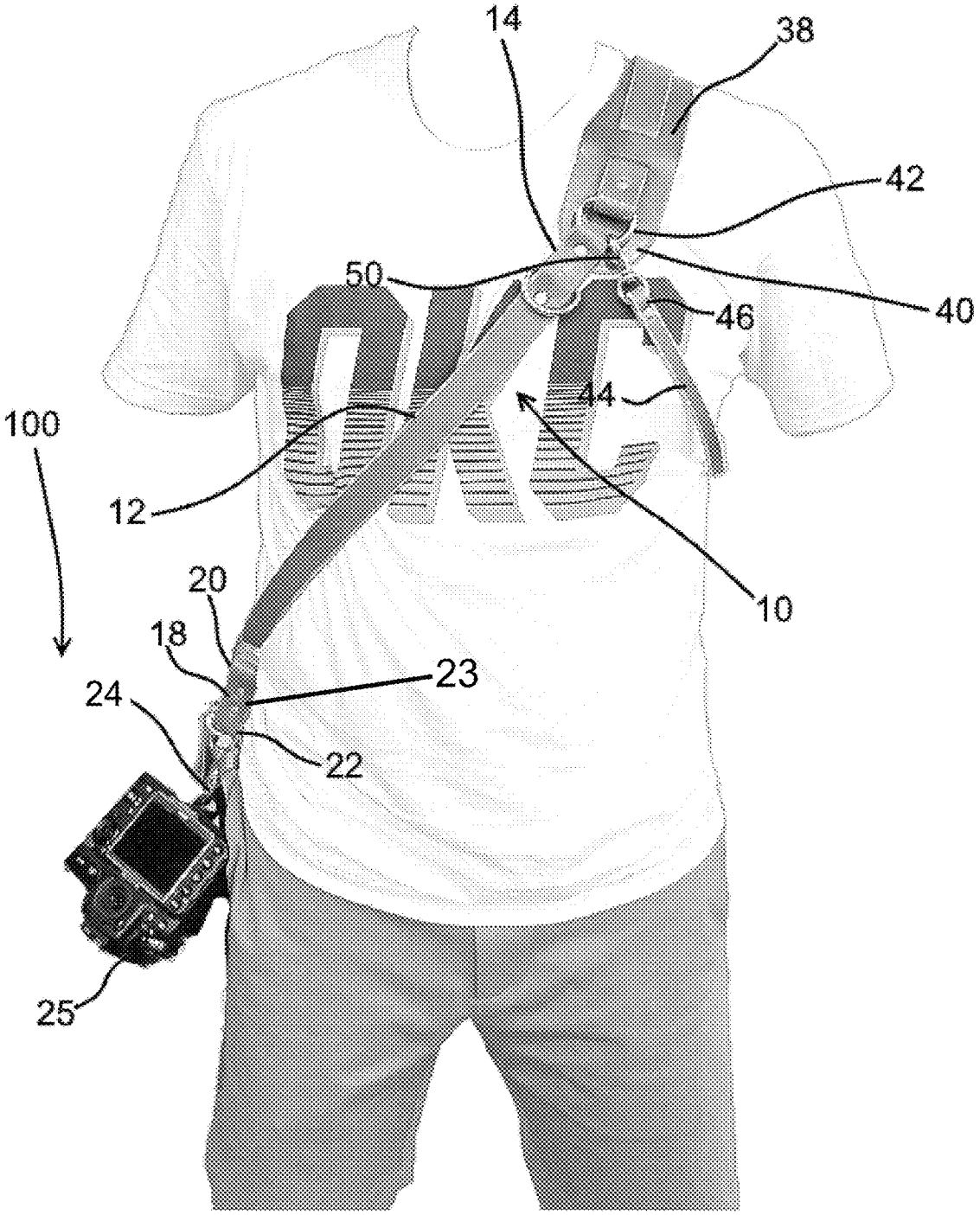
FIG. 1A is a front view of a camera sling having two camera stabilization features, in accordance with the features of the present invention.

An exemplary embodiment of the invented device is shown in FIGS. 1A and B and designated as numeral 10. The device 10 includes a strap 12 extending a length between a first end 14 and a second end 16 (shown in FIG. 1B). When worn by a user, the first end of the strap 14 overlays an anterior portion of the user's shoulder or chest and extends diagonally therefrom toward the hip opposite the overlaid shoulder. The strap 12 then extends diagonally upwardly over the back of the user to its second end 16 that overlays a posterior portion of the user's shoulder or back. At the first and second ends of the 14, 16 of the strap, the strap is reversibly attached to D-Rings 42 that are disposed on both sides of a shoulder pad 38. The length of the strap 12 between its first and second ends can be any length and can be customized to fit any user. Preferably, the length of the strap between its first and second ends is preferably between approximately 24 to approximately 48 inches in length and typically approximately 29 to approximately 39 inches.

As shown in FIG. 1A, a camera slider 18 depends from the strap 12. The camera slider 18 has a first end 20 and a second end 22, the first end 20 in slidable communication with the length of the strap 12 and the second end 22 reversibly coupled to a camera attachment means 24. The camera attachment means may comprise any reversibly attachable clips that are robust enough to remain attached to a hanging camera. Exemplary clips include quick-detach or quick-release clips, swivel shackles, snap shackles, and combinations thereof.

Figure 1B:
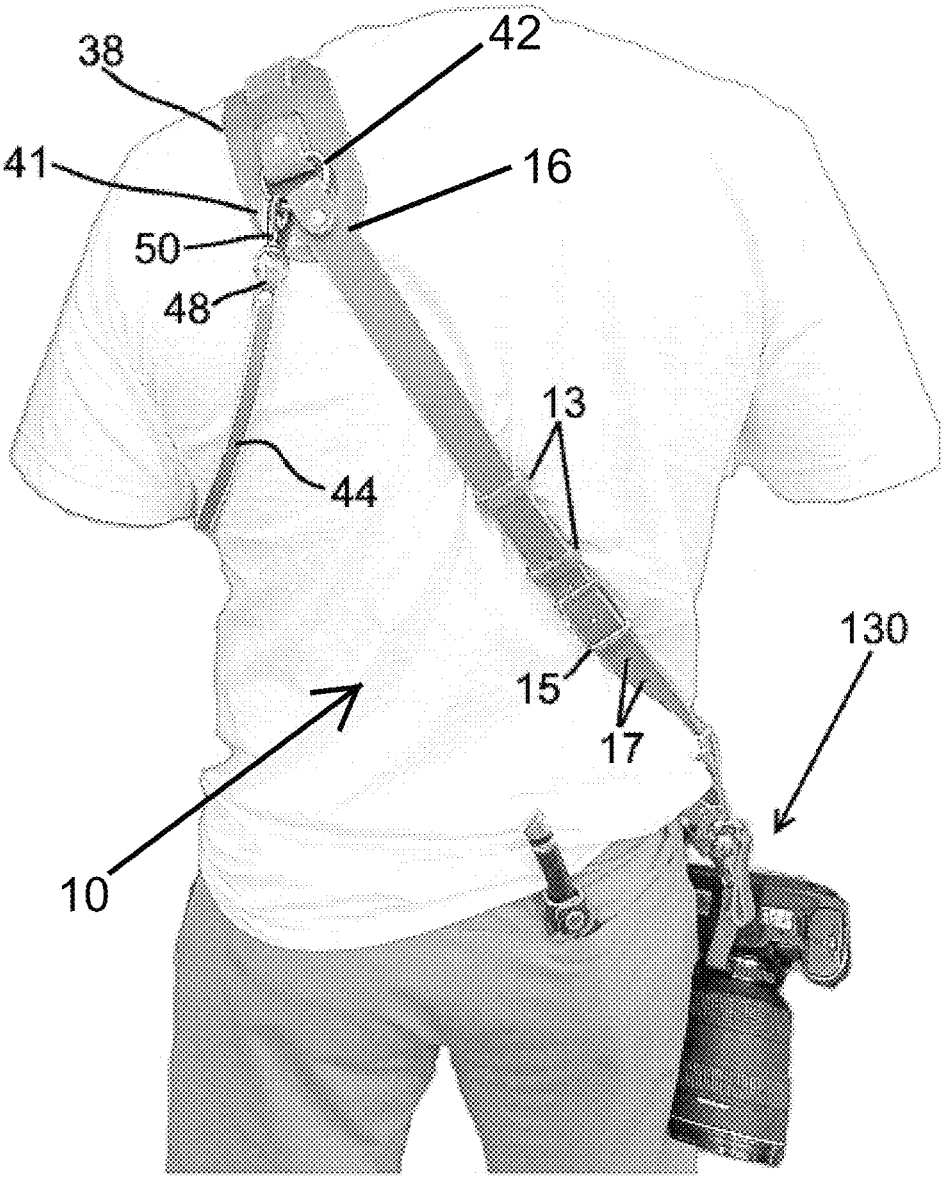
FIG. 1B is a back view of a camera sling having two camera stabilization features, in accordance with the features of the present invention.

In an embodiment, the strap 12 is a single continuous strap. Alternatively, as shown in FIGS. 1A-B, the strap 12 actually comprises two straps that are joined together using apertures 17 in the straps and the buckle 15 as described in U.S. patent application Ser. No. 15/471,163 filed on Mar. 28, 2017, the entirety of which is incorporated by reference herein, in order to provide the ability to adjust the length of the camera sliders. The buckle 15 shown in FIGS. 1A-B is only an exemplary piece of hardware. In alternative embodiments, the buckle 15 may be any piece of hardware suitable for adjusting the length of a strap such as a belt buckle or Conway buckle. The strap 12, may feature belt loops 13 to manage any extra length of strap.

Figure 1C:
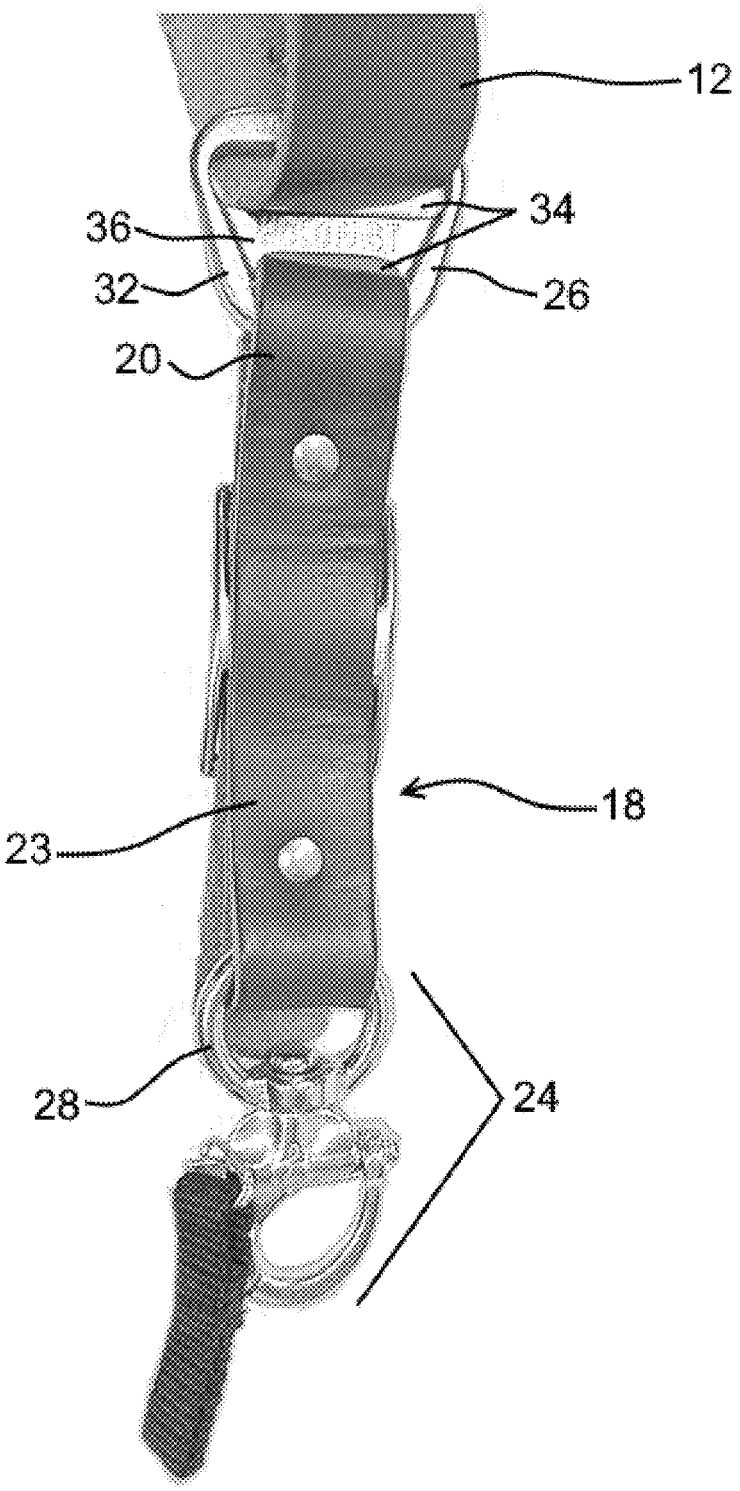
FIG. 1C. is a detail view of a camera slider for a camera sling, in accordance with the features of the present invention.

FIG. 1C is a detail view of a camera slider 18. As shown, the slider 18 comprises a length of a secondary strap 23 that extends between the first 20 and second ends 22 of the slider 18. In this embodiment, the length of strap 23 is a loop of material that is reversibly received by the slider hardware 26 at the first end of the slider 20 and the ring portion 28 of the camera attachment means 24 at the second end of the slider 22. The slider hardware 26 receives both the strap portion 23 of the slider 18 and the larger strap 12 of device. When the slider hardware 26 is in receipt of both the slider strap 23 and the larger strap l2, this places the slider 18 in slidable communication with the strap 12 such that the slider 18 can slide along the length of the larger strap 12 of the device 10. In an embodiment, the camera sliders are fixed in length. The length of the sliders can be customized to any length for any user. Preferably, the sliders are between approximately 2 and approximately 9 inches in length. Typically, the sliders are between approximately 3 and approximately 3 inches in length.

In an embodiment, the sliders 18 feature the apertures and buckle device described in U.S. patent application Ser. No. 15/471,163 filed on Mar. 28, 2017, the entirety of which is incorporated herein, in order to provide the ability to adjust the length of the camera sliders 18.

FIG. 1C shows the slider hardware 26 as a customized ring designed for this use featuring a pentagonally shaped outer ring 32, wherein the interior of the outer ring 32 is divided into two voids 34 by a medially positioned rib 36. Said medial rib 36 prevents friction between the slider strap 23 and the larger strap 12 of the device when the slider slides along the strap. The pentagonal ring shown here is an exemplary piece of hardware that is suitable for use as the slider hardware 26 herein and not meant to be limiting. The slider hardware 26 may be any shape and may have separate voids that respectively receive the larger strap 12 and the slider strap 23. Alternatively, the slider hardware 26 may only feature one void that receives both the larger strap 12 and the slider strap 23. Further, the slider hardware 26 can be made from any robust material that can support the weight of a camera 25. Suitable materials include metal, plastic, wood, and combinations thereof.

As shown in FIG. 1C, the ring portion 28 of the camera attachment means 24 receives the strap portion 23 of the slider 18. The camera attachment means 24 may be any piece of hardware that can reversibly attach to an accessory clip that is received by the tripod port on a camera 25. Suitable accessory clips include any lug and loop accessory clip that screws into the tripod port on a camera 25. Exemplary accessory clips are the holdfast accessory clips sold by Holdfast Gear, LLC of Tulsa Okla. When the invented device is in use, a camera 25 is attached to the camera slider 18 via the attachment means 24. If a user is not using the camera 25 and supporting it with their hands, the camera 25, in a default position, hangs down at a user's side.

Returning to FIGS. 1A-B, the device 10 features a shoulder pad 38 that overlays the shoulder of a user while the device is worn. In the embodiment shown in FIGS. 1A-B, the shoulder pad 38 extends between a first 40 and second end 41. Each end of the shoulder pad 38 features a D-ring 42 to which an end of the strap 12 reversibly attaches. In alternative embodiments, the shoulder pad 38 is a substrate having two apertures such that the strap 12 is received by the apertures such that the shoulder pad encircles the portion of the strap overlaying a user's shoulder.

Looking to FIGS. 1A-B, the device 10 features a stabilizing strap 44. Said stabilizing strap comprises a strap extending between a first end 46 and a second end 48, wherein the first and second ends both comprise clips 50. The clips 50 may comprise any reversibly attachable clips. Exemplary clips include quick-detach or quick-release clips, swivel shackles, snap shackles, and combinations thereof. In the configuration shown in FIGS. 1A-B, the stabilization strap 44 is in its stabilizing configuration wherein the clips 50 of the stabilization strap 44 are reversibly attached to both D-rings 42 on the shoulder pad 38. The stabilizing configuration of the stabilization strap features the stabilization strap 44 extending between the two D-rings 42 and under the arm of the user such that the stabilization strap and shoulder pad encircle the user's arm. In this configuration, the stabilization strap 44 minimizes movement of the whole device while in use.

Figure 1D:
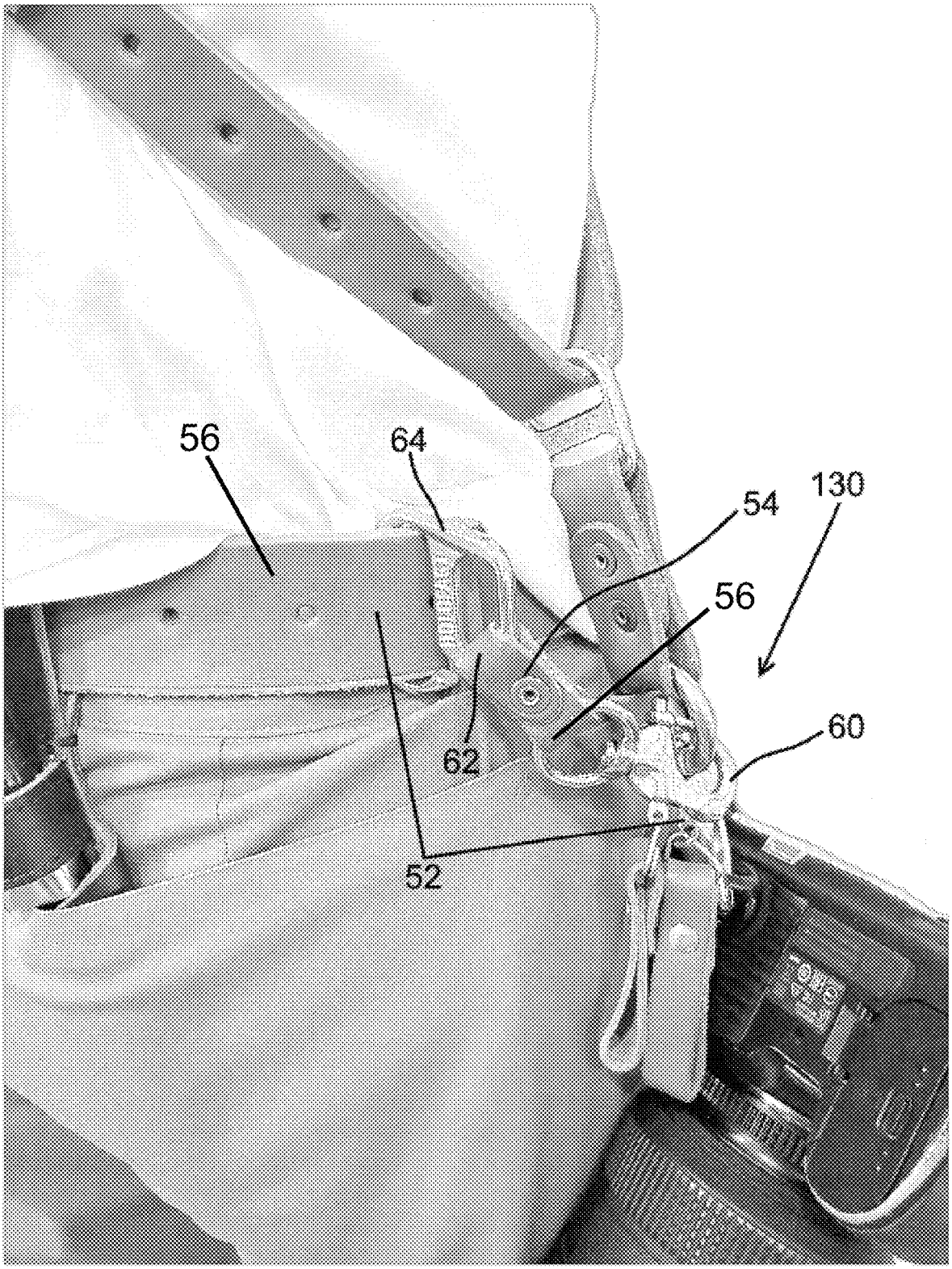
FIG. 1D is a rear view of an embodiment of a camera stabilizing device, in accordance with the features of the present invention.

The device 10 may feature another stabilizing feature 52 shown in FIG. 1D. This stabilizing feature 52 is a strap 54 extending from the belt 56 of a user to a terminal end 58 comprising a clip 60. Said strap 54 has a first end 62 comprising a ring 64 that, is reversibly attachable to a user's belt 56. In an alternative embodiment, the ring 64 at the first end 62 of the stabilizing feature is either integrally included in the belt of a user or reversibly attached to the belt loop of a user.

Figure 1E:
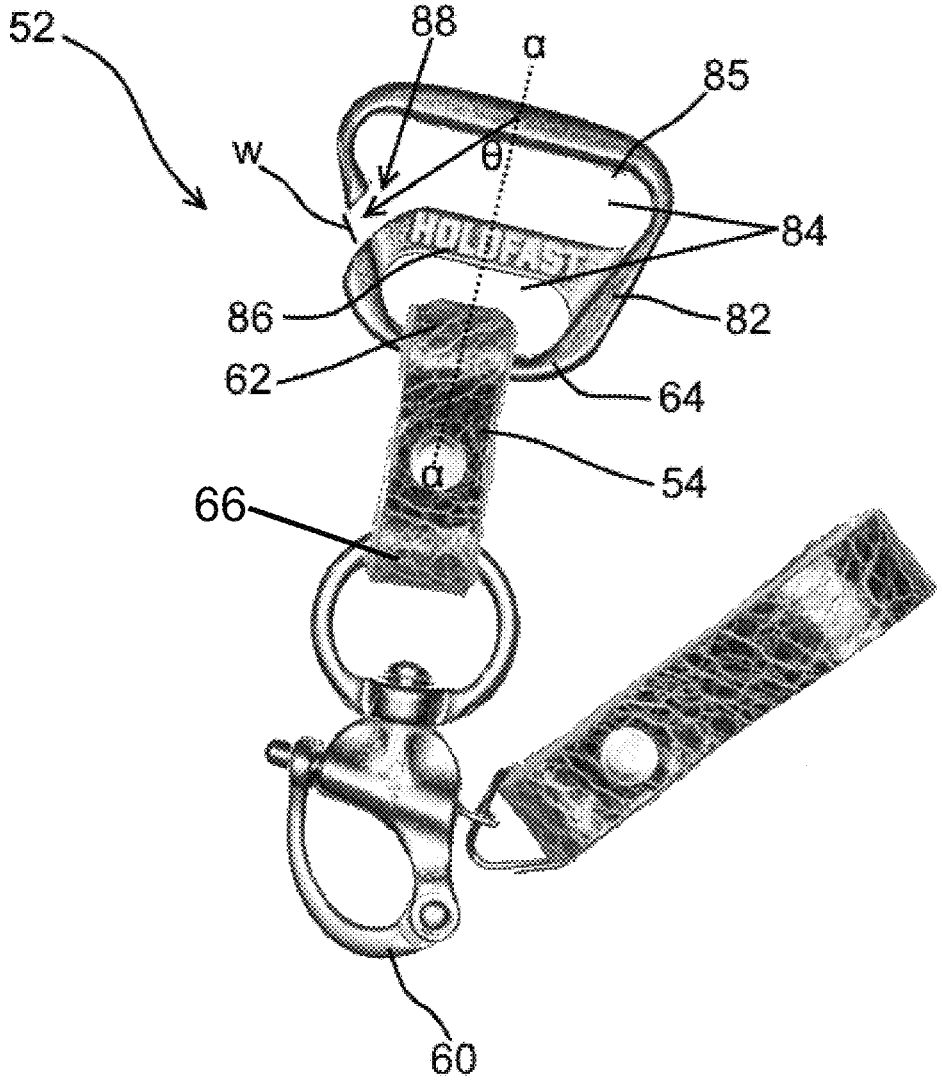
FIG. 1E is a detail view of a waist-mounted camera stabilizing device, in accordance with the features of the present invention.

FIG. 1E is a detail view of the stabilizing feature 52 shown in FIG. 1D. As shown, the stabilizing feature 52 comprises a strap 54 attached at its first end 62 to a waist attachment clip 64 and attached at its second end 66 to a camera attachment means 60. The waist attachment clip 64 is similar to the slider hardware described above in that it features an outer ring 82 whose interior is divided into two voids 84 by a medial rib 86. One of the voids 85 receives the stabilizing feature's strap 54. A portion of the outer ring 82 surrounding the void 85 that receives the strap 54 has a notch 88 that allows for the sliding of an object thinner than the width w of the notch to slide into the notch and into the void 85. The waist attachment clip 64 is designed so that the notch 88 can reversibly receive the fabric of a user's waistband or belt 56. The notch can be made to have any width w to accommodate fabrics or leathers of any kind. Typically, the notch is between approximately ⅛ and approximately ½ inch wide.

The notch 88 extends at an angle θ to the longitudinal axis a of the waist attachment clip 64. The notch is designed to be non-parallel to the longitudinal axis a of waist attachment clip 64 so that once the waist attachment clip 64 is slid over a user's waistband or belt, the received fabric will not slide directly back out of the notch. Similar to the width of the notch, the angle θ can be customized to be any angle and is preferably between approximately 0 and approximately 90 degrees. Typically, the angle θ is between approximately 20 and approximately 45 degrees.

A salient feature of the embodiment shown in FIG. 1E is the ability to utilize it with any existing camera sling or harness wherein a supported camera hangs free when not in use. Using the stabilizing feature shown in FIG. 1E, a user can place the feature on their belt and limit the movement of a camera hanging free from any sling or harness. The stabilizing feature of FIG. 1E is amenable for use with existing systems without any need to modify those existing systems.

All straps discussed herein are made from any suitably robust material. Typical materials include leather, canvas, goretex, nylon, cotton, polyester, rubber, and combinations thereof. The shoulder pad described above is made from similar materials.

Anchoring Detail

Figure 1F:
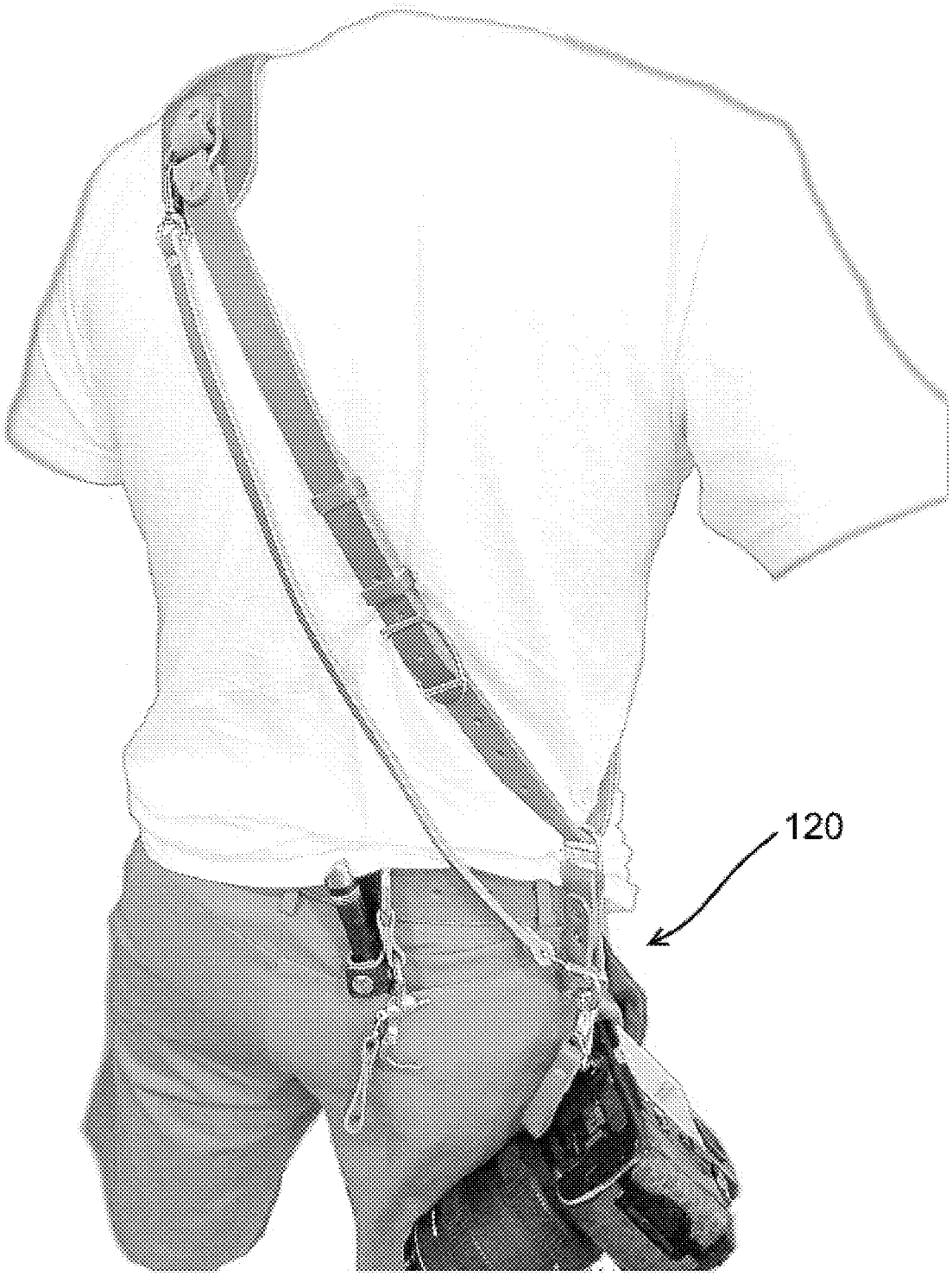
FIG. 1F is a rear view of a camera sling having two camera stabilization features, in accordance with the features of the present invention.

When in use, the device provides a sling 10 configured to suspend a camera 25 secured to a camera slider. The device 10 allows a camera 25 to freely slide along the length of its strap 12 on either end of the shoulder pad shoulder pad 38. In this position 100 as shown in FIG. 1A a user may hold the camera 25 and position it. When the user is not holding the camera 25, it hangs from the device 10 by the slider 18 in a position near a hip of the user. If the user of the device then begins a period of active movement such as walking, running, climbing, or any other activity that would jostle the freely hanging camera 25, he or she may use the stabilization strap 44 of the device to anchor the camera 25 and limit its movement to reach position 120 as shown in FIG. 1F.

In order to reach position 120 from the idle position where the camera 25 hangs free, a user unclips the clip comprising the first end of the stabilization strap from the D-ring 42 on the chest side of the shoulder pad of the device. The user then moves the stabilization strap so that it runs down their back and reversibly clips the free clip of the stabilization strap to the ring of the camera attachment means as shown in FIG. 1F. In position 120, the stabilization strap is a fixed length and therefore limits the movement of the hanging camera.

Once the position of the camera is limited in position 120, the user can then free the camera 25 to be ready-to-shoot by disengaging the clip 50 of the stabilization strap from the ring of the camera attachment means, running the stabilization strap under their arm and re-engaging the stabilization strap's free clip to the chest side D-ring 42. This places the device back into position 100.

Alternatively or in conjunction with the stabilization strap 44, the waist mounted anchoring means 52 can be used to limit the movement of a camera hanging from a camera sling. As shown and discussed above, in position 100, the device provides a camera 25 that is free to slide along the length of the strap on either side of the shoulder pad. Where a user desires to begin active movement, they may attach the belt-mounted stabilizing feature 52 to the ring portion 28 of the camera attachment means 24 to move into the stabilized position 130 as shown in FIGS. 1B and 1D.

In the stabilized configurations shown in FIGS. 1B, D, and F, the stabilizing strap 44 or belt-mounted stabilizing feature 52 limit jostling and movement of the camera while a user actively moves while the camera 25 hangs during walking, hiking, climbing or other active periods. These stabilizing features prevent damage to the camera 25 and accessories by limiting large and fast movements. The stabilizing features further prevent the full weight of a camera and a lens from repeatedly striking the user, preventing potential bruises, irritation, and lacerations.

Both stabilization features shown and discussed above prevent movement of a secured camera 25 (positions 120 and 130) beyond an allowed distance as controlled by the fixed length of either stabilizing feature. Preferably, once the invented device is in a stabilizing configuration (120 and 130), the camera can only move a maximum of between approximately one and approximately six inches away from an idle hanging position. Typically, the camera is not allowed to move more than approximately three inches when in a stabilized configuration. These figures are exemplary and not meant to be limiting. The movement of the camera in a stabilized position can be customized by lengthening the stabilizing features (either the stabilizing strap or the waist-bound stabilizing feature). For example, a photographer using the invented device with a heavy camera/lens configuration may desire that the camera be allowed to move less than the distances cited above. In such a case, the lengths of either stabilizing feature can be customized to achieve the desired movement of the camera in a stabilized configuration.

A salient feature of the invention is the ability to rapidly engage a stabilization feature to a free-hanging camera when minimized swinging of the camera is desired. For example, using any embodiment of the stabilization feature, only one step is needed to engage a free clip on the end of the stabilization means to the camera attachment means of the camera slider. Such an engagement step can be performed rapidly using one hand. Similarly, the stabilization means can be released from the camera attachment means using one hand and one step to release the clip of the stabilization means from the camera attachment means.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," "more than" and the like include the number recited and refer to ranges which can be subsequently broken down into subranges as discussed above. In the same manner, all ratios disclosed herein also include all subratios falling within the broader ratio.

One skilled in the art will also readily recognize that where members are grouped together in a common manner, such as in a Markush group, the present invention encompasses not only the entire group listed as a whole, but each member of the group individually and all possible subgroups of the main group. Accordingly, for all purposes, the present invention encompasses not only the main group, but also the main group absent one or more of the group members. The present invention also envisages the explicit exclusion of one or more of any of the group members in the claimed invention.

The invention claimed is:

1. An equipment sling with anchor point comprising:

a first strap configured to overlay a shoulder of a user and extend downwardly across a front and back of said user toward a hip of the user opposite the overlaid shoulder, wherein said first strap has a length;

a secondary strap having a first end and a second end, wherein the first end is in slidable communication with the first strap along the length of the first strap, and wherein the second end comprises means for reversibly fixing the secondary strap to said equipment, wherein the equipment hangs at an idle position when the equipment is not in use; and an anchoring mechanism reversibly attached to the second end of the secondary strap such that the equipment is prevented from moving farther from the idle position than a predetermined distance, wherein the anchor point comprises a tertiary strap having a first end and a second end, wherein the first end comprises a clip reversibly attached to a belt worn by the user, and the second end comprises a clip configured to reversibly engage the means for reversibly fixing a camera to secondary strap, and wherein the clip reversibly attached to a belt worn by the user comprises an outer ring having an interior space divided into two voids by a medial rib, and wherein a portion of the outer ring surrounding the void nearest the user defines a notch extending through the outer ring and into the void nearest the user.

2. The equipment sling of claim 1 wherein the notch reversibly receives the belt of a user.

3. The equipment sling of claim 1 wherein the notch has a width between ⅛ inch and ½ inch.

4. The equipment sling of claim 1 wherein the clip reversibly attached to a belt worn by the user has a longitudinal axis, and wherein the notch extends at an angle from the longitudinal axis of the clip reversibly attached to a belt worn by a user.

5. The equipment sling of claim 4 wherein the angle is between 20 and 45 degrees.

6. A method for limiting movement of equipment suspended from a sling comprising:

a) providing a shoulder sling having a primary strap configured to overlay a shoulder of a user and extend downwardly across a front and back of said user toward a hip of the user opposite the overlaid shoulder and equipment suspended from said primary strap by a secondary strap, wherein the secondary strap is in slidable communication with the primary strap;

b) providing an anchoring mechanism that reversibly limits a range of movement of the secondary strap along the primary strap when the anchoring mechanism is reversibly attached to the secondary strap, wherein the anchoring mechanism comprises a tertiary strap having a first and second end and wherein the tertiary strap has a stabilizing configuration wherein the tertiary strap extends under a user's arm between its first and second ends that are both reversibly attached to the primary strap; and c) reversibly attaching said anchoring mechanism to said secondary strap.

7. The method of claim 6 wherein the tertiary strap has an anchoring configuration wherein the tertiary strap attaches at its first end to a portion of the primary strap overlaying a posterior portion of the user's shoulder and extends downwardly across the user's back toward an opposite hip and reversibly attaches to the secondary strap.

8. The method of claim 7 further comprising moving the tertiary strap from its stabilizing configuration to its anchoring configuration.

9. The method of claim 8 wherein moving the tertiary strap from its stabilizing configuration to its anchoring configuration comprises:

a) detaching the first end of the tertiary strap from the primary strap;

b) moving the tertiary strap so that it runs down the back of the user; and c) reversibly attaching the first end of the tertiary strap to the secondary strap.

10. The method of claim 8 further comprising moving the tertiary strap from its anchoring configuration to its stabilizing configuration.

11. An equipment sling with anchor point comprising:

a first strap configured to overlay a shoulder of a user and extend downwardly across a front and back of said user toward a hip of the user opposite the overlaid shoulder, wherein said first strap has a length;

a secondary strap having a first end and a second end, wherein the first end is in slidable communication with the first strap along the length of the first strap, and wherein the second end comprises means for reversibly fixing the secondary strap to said equipment, wherein the equipment hangs at an idle position when the equipment is not in use, and wherein the anchoring mechanism further comprises:

a pad that encircles the first strap and is configured to overlay the shoulder of a user, the pad further comprising;

a first end overlaying a portion of the chest of a user and a second end overlaying a portion of the back of a user, wherein an attachment point is disposed on both ends of the pad;

a stabilizing strap having a first end and a second end, wherein each end of the stabilizing strap comprises a clip; and an anchoring mechanism reversibly attached to the second end of the secondary strap such that the equipment is prevented from moving farther from the idle position than a predetermined distance.

12. The equipment sling of claim 11, wherein the stabilizing strap has a stabilizing configuration comprising:

an end of the stabilizing strap reversibly clipped to one of the attachment points on the pad, and wherein the other end of the strap is reversibly clipped to the other attachment point on the pad such that the stabilizing strap extends from one attachment point on the pad under the armpit of a user and to the other attachment on the pad.

13. The equipment sling of claim 12, wherein the stabilizing strap has an anchoring configuration comprising:

the first end of the stabilizing strap reversibly clipped to the attachment point disposed on the second end of the pad, the length of the stabilizing strap extending diagonally downward across a user's back, wherein the second end of the stabilizing strap is reversibly engaged to the means for reversibly fixing a camera to the secondary strap.

14. The equipment sling of claim 13 wherein the stabilizing strap is configured to reversibly convert from its stabilizing configuration to its anchoring configuration, and from its anchoring configuration to its stabilizing configuration.

* * * * *